US010870906B2

(12) United States Patent
Leoni et al.

(10) Patent No.: US 10,870,906 B2
(45) Date of Patent: Dec. 22, 2020

(54) PLATINUM ALLOY

(71) Applicant: OMEGA SA, Biel/Bienne (CH)

(72) Inventors: Edwina Leoni, Courtelary (CH); Gregory Kissling, Macolin (CH); Denis Vincent, Neuchatel (CH); Stephane Lauper, Cortaillod (CH); Alban Dubach, Bienne (CH); Gaetan Villard, Cossonay (CH)

(73) Assignee: OMEGA SA, Biel/Bienne (CH)

( * ) Notice: Subject to any disclaimer, the term of this patent is extended or adjusted under 35 U.S.C. 154(b) by 112 days.

(21) Appl. No.: 16/211,268

(22) Filed: Dec. 6, 2018

(65) Prior Publication Data

US 2019/0185965 A1 Jun. 20, 2019

(30) Foreign Application Priority Data

Dec. 20, 2017 (EP) ..... 17208872

(51) Int. Cl.

| | |
|---|---|
| ***C22C 5/04*** | (2006.01) |
| ***A44C 5/00*** | (2006.01) |
| ***G04B 3/04*** | (2006.01) |
| ***G04B 19/04*** | (2006.01) |
| ***G04B 37/22*** | (2006.01) |
| *A44C 27/00* | (2006.01) |

(52) U.S. Cl.

CPC ..... *C22C 5/04* (2013.01); *A44C 5/00* (2013.01); *G04B 3/04* (2013.01); *G04B 19/04* (2013.01); *G04B 37/22* (2013.01); *A44C 27/003* (2013.01)

(58) Field of Classification Search

CPC .... C22C 5/04; A44C 5/00; G04B 3/04; G04B 19/04; G04B 37/02

See application file for complete search history.

(56) References Cited

U.S. PATENT DOCUMENTS

| | | | |
|---|---|---|---|
| 4,165,983 | A | 8/1979 | Bourne et al. |
| 2005/0284257 | A1 | 12/2005 | Osada et al. |

FOREIGN PATENT DOCUMENTS

| | | |
|---|---|---|
| GB | 144 119 | 6/1920 |
| JP | 2005-29879 | 2/2005 |

OTHER PUBLICATIONS

European Search Report dated Mar. 12, 2018 in European Application 17208872.6, filed on Dec. 20, 2017 ( with English translation of categories of Cited Documents).

Office Action dated Jun. 22, 2020, in Chinese patent application No. 201811492444.6, (w/English translation), (9 pages).

Precious Metal Jewelry Materials, Beijing Metallurgical Industry Press, p. 142 and two cover pages, 2013, Edited by Yuantao Ning et al, (w/translation) total 7 pages.

*Primary Examiner* — Jessee R Roe

(74) *Attorney, Agent, or Firm* — Oblon, McClelland, Maier & Neustadt, L.L.P.

(57) ABSTRACT

A nickel-free and cobalt-free platinum alloy including, expressed by weight, from 95.0% to 96.0% of Pt, from 0.5% to 4.5% of Ir, from 0.01% to 2% of Au, from 0 to 2% of Ge, and from 0 to 1% of at least one of the alloying elements Ru, Rh, Pd, Sn, Ga, Re, the respective percentages of all of the elements of the alloy adding up to 100%.

6 Claims, No Drawings

PLATINUM ALLOY

CROSS-REFERENCE TO RELATED APPLICATION

This application claims priority to European Patent Application No. 17208872.6 filed on Dec. 20, 2017, the entire disclosure of which is hereby incorporated herein by reference.

FIELD OF THE INVENTION

The present invention relates to a nickel-free and cobalt-free platinum alloy. The invention also relates to a timepiece or piece of jewellery comprising at least one component made with such an alloy.

BACKGROUND OF THE INVENTION

There are several families of platinum-based alloys on the market that are used in watchmaking and jewellery. These alloys have the distinctive feature of being mainly used at an internationally recognised grade of 95%, which greatly limits the content of the alloying elements. The alloying elements will therefore meet a technical constraint specific to the element. The first conventional alloying elements are ruthenium, cobalt, copper, iridium. They may be combined with a second element such as gallium, indium, tin, gold, rhodium, tungsten or palladium. Platinum alloys containing ruthenium have a universal use for jewellery and watchmaking, in particular for machined products. Platinum alloys containing cobalt meet the technique of lost-wax casting. Alloys containing copper meet an economical demand of the market. Alloys containing iridium are used in jewellery for their brilliance. Therefore, each alloy only meets a very limited number of constraints.

The drawback of a platinum alloy containing iridium is that at the 95% grade the alloy is very soft and does not meet watchmaking constraints. In order to meet these constraints, some people use platinum/iridium alloys having lower contents of platinum such as 90%, 85%, or even 80%. The drawback of this situation is that they can no longer be hallmarked at the grade of 95%.

Table 1 below mentions the hardnesses of the platinum alloys as a function of the iridium contents in the annealed condition.

TABLE 1

Annealed hardness of the platinum alloys.

| Pt80Ir20 | Pt85Ir15 | Pt90Ir10 | Pt95Ir5 |
|---|---|---|---|
| 242 HV | 172 HV | 120 HV | 76 HV |

There are several platinum-iridium alloys on the market, which are described below.

Patent FR 2381832 A1 relates to alloys of at least 95% of platinum comprising iridium and gallium between 1.5% and 3.5% or indium between 0.5% and 3.5% by weight, which lowers the melting point of the alloys and makes it possible to cast them more easily.

Patent JP1515724C relates to alloys comprising 80-85% of platinum, 0.05% to 5% of mischmetal and 1% to 15% in total of elements comprising, inter alia, iridium, the introduction of mischmetal improving the hardness and the castability of the alloy.

Patent JP1509078C relates to alloys comprising 90-95% of platinum, 0.01% to 3% of Ca or calcium boride and 1% to 15% in total of elements comprising, inter alia, iridium. The introduction of boron and calcium boride is useful for improving the castability and also for refining the size of the grains of the alloy.

Patent JP S61134134A relates to alloys comprising 84% to 96% of platinum, 1% to 15% of palladium, 0.5% to 5% of Co and 0.1% to 5% of iridium, the Pd—Co combination increasing the hardness of the alloys.

The alloys described in these four patents may chromatically have excessively high values of a* and b* and a platinum grade that is sometimes less than 95%, these two features not making it possible to claim to use said alloys in the field of watchmaking and jewellery.

SUMMARY OF THE INVENTION

The objective of the present invention is therefore to substantially improve the platinum alloys at the grade of 95% containing iridium by providing a nickel-free and cobalt-free platinum alloy having mechanical characteristics that meet the watchmaking criteria while retaining the colour and luminosity specific to platinum-iridium alloys.

Another objective of the present invention is to provide a nickel-free and cobalt-free platinum alloy at the grade of 95% containing iridium that has an advantageous compromise between good machinability, castability, crimpability and polishability.

For this purpose, the present invention relates to a nickel-free and cobalt-free platinum alloy, comprising, expressed by weight, from 95.0% to 96.0% of Pt, from 0.5% to 4.5% of Ir, from 0.01% to 2% of Au, from 0 to 2% of Ge, and from 0 to 1% of at least one of the alloying elements Ru, Rh, Pd, Sn, Ga, Re, the respective percentages of all of the elements of the alloy adding up to 100%.

With an alloy corresponding to the abovementioned definition, a platinum alloy is obtained that meets all of the criteria required for alloys intended to be used in the watchmaking and jewellery field, in particular as regards its colour and its brilliance and also its ability to be machined, cast, polished and crimped.

The present invention also relates to a timepiece or piece of jewellery comprising at least one component made from an alloy as defined above. This component is for example a watch case, a dial, a bracelet or watch strap, a bracelet or watch strap clasp or buckle, a crown, an index, an applique, a hand, a jewel or an accessory.

The present invention also relates to the use of an alloy as defined above in a timepiece or piece of jewellery.

DETAILED DESCRIPTION OF PREFERRED EMBODIMENTS

The alloy of the present invention is a nickel-free and cobalt-free platinum alloy at the grade of 95%.

According to the invention, the platinum alloy comprises, expressed by weight, from 95.0% to 96.0% of Pt, from 0.5% to 4.5% of Ir, from 0.01% to 2% of Au, from 0 to 2% of Ge, and from 0 to 1% of at least one of the alloying elements Ru, Rh, Pd, Sn, Ga, Re, the respective percentages of all of the elements of the alloy adding up to 100%.

According to a first variant, the platinum alloy comprises, expressed by weight, from 95.0% to 96.0% of Pt, from 2.2% to 4.4% of Ir, from 0.01% to 0.8% of Au, from 0.01% to 1.5% of Ge, and from 0 to 1% of at least one of the alloying elements Ru, Rh, Pd, Sn, Ga, Re, the respective percentages of all of the elements of the alloy adding up to 100%.

According to a second variant, the platinum alloy comprises, expressed by weight, from 95.0% to 96.0% of Pt, from 2.9% to 4.3% of Ir, from 0.05% to 0.6% of Au, from 0.01% to 1% of Ge, and from 0 to 1% of at least one of the alloying elements Ru, Rh, Pd, Sn, Ga, Re, the respective percentages of all of the elements of the alloy adding up to 100%.

According to a third variant, the platinum alloy comprises, expressed by weight, from 95.0% to 96.0% of Pt, from 3.5% to 4.2% of Ir, from 0.05% to 0.6% of Au, from 0.06% to 0.5% of Ge, and from 0 to 1% of at least one of the alloying elements Ru, Rh, Pd, Sn, Ga, Re, the respective percentages of all of the elements of the alloy adding up to 100%.

The alloying elements, such as Ru, Rh and Ga may be used for improving the hardness, Sn makes it possible to lower the melting temperature, Re and Pd have the same behaviour as the platinum elements.

The platinum alloys according to the invention find a particular application for the production of a timepiece or piece of jewellery. In this application, this alloy makes it possible in particular to have a brilliant colour and also sufficient hardness for being machined, cast, crimped and polished.

In order to prepare the platinum alloy according to the invention, the following processes are carried out:

The main elements incorporated into the composition of the alloy have a purity of between 999 and 999.9 per thousand and are deoxidized.

The elements of the composition of the alloy are placed in a crucible that is heated until the elements melt.

The heating is carried out in an airtight induction furnace under partial pressure of nitrogen.

The molten alloy is cast in an ingot mould.

After solidification, the ingot is subjected to water quenching.

Next the quenched ingot is cold-rolled and then annealed. The degree of work hardening between each annealing is from 66% to 80%.

Each annealing lasts 20 to 30 minutes and is carried out between 900° C. and 1100° C. under a reducing atmosphere composed of $N_2$ and $H_2$.

The cooling after the annealing operations is carried out by water quenching.

The examples which follow were carried out in accordance with the conditions disclosed in Table 2 below and all relate to 95% platinum alloys or to commercial platinum alloy references. The proportions indicated are expressed as percentages by weight.

TABLE 2

Table of the compositions of the alloys tested.

| | Pt | Ir | Au | Ge |
|---|---|---|---|---|
| 1 (comp) | 80 | 20 | | |
| 2 (comp) | 85 | 15 | | |
| 3 (comp) | 90 | 10 | | |
| 4 (comp) | 95 | 5 | | |
| 5 (inv) | 95.3 | 3.5 | 1 | 0.2 |
| 6 (inv) | 95.3 | 4 | 0.5 | 0.2 |
| 7 (inv) | 95.3 | 4.5 | 0.01 | 0.19 |
| 8 (inv) | 95.3 | 4.2 | 0.01 | 0.49 |
| 9 (inv) | 95.3 | 3.7 | 0.01 | 0.99 |

The various properties of the alloys obtained according to Examples no. 1 to no. 9 from Table 2 will be found in Table 3 below.

Table 3 in particular gives information relating to the Vickers hardness of the alloy in the annealed condition, and also to the colour measured in a three-axis coordinate system.

This three-dimensional measurement system referred to as CIELab, CIE being the acronym of the International Commission on Illumination in French and Lab being the three coordinate axes, the L axis measuring the white-black component (black=0; white=100), the a axis measuring the red-green component (red=positive values +a; green=negative values −a) and the b axis measuring the yellow-blue component (yellow=positive values +b; blue=negative values −b). (cf. standard ISO 7724 established by the International Commission on Illumination).

The colorimetric values are measured with a MINOLTA CM 3610 d machine under the following conditions:

Illuminant: D65

Tilt: 10°

Measurement: SCI+SCE (specular component included+excluded)

UV: 100%

Measurement focal length: 4 mm

Calibration: black body and white body

TABLE 3

Table of the colours and hardness of the alloys tested.

| | L | a* | b* | HV |
|---|---|---|---|---|
| 1 (comp) | 88.4 | 0.6 | 3.4 | 242 |
| 2 (comp) | 88.4 | 0.6 | 3.7 | 172 |
| 3 (comp) | 87.6 | 0.6 | 4.0 | 130 |
| 4 (comp) | 88.1 | 0.7 | 4.0 | 76 |
| 5 (inv) | 87.6 | 0.7 | 4.2 | 145 |
| 6 (inv) | 87.8 | 0.7 | 4.1 | 149 |
| 7 (inv) | 87.5 | 0.7 | 4.3 | 145 |
| 8 (inv) | 87.9 | 0.7 | 4 | 200 |
| 9 (inv) | 87.7 | 0.7 | 4.1 | 210 |

Alloys no. 1 to no. 3 are commercial PtIr binary alloys which have the drawback of having no internationally recognised legal grade.

Alloy no. 4 is the Pt950Ir50 alloy which has the drawback of having too low a hardness to be used in the watchmaking field.

Alloys no. 5 to no. 9 of the invention were produced and tested in deformation in order to meet the double constraint of brilliance/whiteness and of deformability required for alloys intended to be used in the watchmaking and jewellery field, i.e. for having chromatic values such that $L \geq 87$, $a^* \leq 0.7$ and $b^* \leq 4.3$, and also a hardness of between 140 Hv and 220 Hv, and preferably between 140 Hv and 160 Hv.

The alloys of the comparative examples do not make it possible to meet this double constraint.

The invention claimed is:

1. A nickel-free and cobalt-free platinum alloy, comprising, expressed by weight, the following elements:

95.0% to 96.0% of Pt, 2.2% to 4.4% of Ir 0.01% to 0.8% of Au 0.01% to 1.5% of Ge 0 to 1% of at least one of the alloying elements Ru, Rh, Pd, Sn, Ga, Re, the respective percentages of all of the elements of the alloy adding up to 100%.

2. The platinum alloy according to claim 1, comprising, expressed by weight, from 95.0% to 96.0% of Pt, from 2.9% to 4.3% of Ir, from 0.05% to 0.6% of Au, from 0.01% to 1% of Ge, and from 0 to 1% of at least one of the alloying elements Ru, Rh, Pd, Sn, Ga, Re, the respective percentages of all of the elements of the alloy adding up to 100%.

3. The platinum alloy according to claim 1, comprising, expressed by weight, from 95.0% to 96.0% of Pt, from 3.5% to 4.2% of Ir, from 0.05% to 0.6% of Au, from 0.06% to 0.5% of Ge, and from 0 to 1% of at least one of the alloying elements Ru, Rh, Pd, Sn, Ga, Re, the respective percentages of all of the elements of the alloy adding up to 100%.

4. A timepiece or piece of jewellery comprising at least one component made from Nickel-free and cobalt-free platinum alloy, comprising, expressed by weight, the following elements:

95.0% to 96.0% of Pt,
0.5% to 4.5% of Ir
0.01% to 0.8% of Au
0.01 to 2% of Ge
0 to 1% of at least one of the alloying elements Ru, Rh, Pd, Sn, Ga, Re, the respective percentages of all of the elements of the alloy adding up to 100%.

5. The timepiece or piece of jewellery according to claim 4, wherein the at least one component is selected from the group consisting of a watch case, a dial, a bracelet or watch strap, a bracelet or watch strap clasp or buckle, a crown, an index, an applique, a hand, a jewel and an accessory.

6. A method of making a timepiece or piece of jewellery comprising applying the platinum alloy of claim 1 in the timepiece or piece of jewellery.

* * * * *